US011758627B2

(12) United States Patent
De Bondt et al.

(10) Patent No.: US 11,758,627 B2
(45) Date of Patent: Sep. 12, 2023

(54) LIGHT EMITTING DIODE, LED, BASED LIGHTING DEVICE HAVING CIRCUITRY FOR DETECTING PRESENCE OF A HUMAN BODY TOUCHING THE LIVE VOLTAGE

(71) Applicant: SIGNIFY HOLDING B.V., Eindhoven (NL)

(72) Inventors: Guy Louis Paul De Bondt, Herentals (BE); Dalibor Cvoric, Arnhem (NL); Franciscus Jacobus Vossen, Helmond (NL); Haimin Tao, Eindhoven (NL); Hermanus Johannes Maria Vos, Waalre (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 79 days.

(21) Appl. No.: 17/620,849

(22) PCT Filed: Jun. 23, 2020

(86) PCT No.: PCT/EP2020/067492
§ 371 (c)(1),
(2) Date: Dec. 20, 2021

(87) PCT Pub. No.: WO2020/260276
PCT Pub. Date: Dec. 30, 2020

(65) Prior Publication Data

US 2022/0346205 A1 Oct. 27, 2022

(30) Foreign Application Priority Data

Jun. 27, 2019 (EP) ..... 19182895

(51) Int. Cl.
*H05B 45/14* (2020.01)
*H05B 45/50* (2022.01)

(52) U.S. Cl.
CPC ..... *H05B 45/14* (2020.01); *H05B 45/50* (2020.01)

(58) Field of Classification Search
None
See application file for complete search history.

(56) References Cited

U.S. PATENT DOCUMENTS

2014/0015345 A1* 1/2014 Ivey ..... H02H 5/12 307/326
2018/0103524 A1 4/2018 Hsia
2018/0238531 A1* 8/2018 Hsia ..... H05B 47/26
(Continued)

FOREIGN PATENT DOCUMENTS

CN 108901096 A 11/2018

*Primary Examiner* — Anh Q Tran

(57) ABSTRACT

A Light Emitting Diode, LED, based lighting device arranged for connection to an Alternating Current, AC, mains supply, comprising a zero-crossing detection module arranged for detecting a zero-crossing in an AC voltage supplied by said AC mains supply, a detection pulse module arranged for providing a detection pulse based on said detected zero-crossing, a human body detection module arranged for determining a current drawn from said AC mains supply during said provided detection pulse, and for determining presence of a human body based on said determined current, wherein said detection pulse module is arranged for providing said detection pulse during a rising, positive, edge of said AC voltage.

11 Claims, 7 Drawing Sheets

(56) References Cited

U.S. PATENT DOCUMENTS

| | | | | |
|---|---|---|---|---|
| 2018/0310370 | A1* | 10/2018 | Heilman | G01R 27/16 |
| 2019/0032864 | A1 | 1/2019 | Xiong et al. | |
| 2019/0041008 | A1* | 2/2019 | Xiong | F21K 9/278 |
| 2019/0170336 | A1 | 6/2019 | Sun et al. | |

* cited by examiner

LIGHT EMITTING DIODE, LED, BASED LIGHTING DEVICE HAVING CIRCUITRY FOR DETECTING PRESENCE OF A HUMAN BODY TOUCHING THE LIVE VOLTAGE

CROSS-REFERENCE TO PRIOR APPLICATIONS

This application is the U.S. National Phase application under 35 U.S.C. § 371 of International Application No. PCT/EP2020/067492, filed on Jun. 23, 2020, which claims the benefit of European Patent Application No. 19182895.3, filed on Jun. 27, 2019. These applications are hereby incorporated by reference herein.

FIELD OF THE INVENTION

The present disclosure is directed to an LED based lighting device having circuitry for detecting presence of a human body and, more specifically, to detecting the presence of a human body in the power loop.

BACKGROUND OF THE INVENTION

Fluorescent TL tubes are inherently safe because the gas inside the tube first has to be ignited before there is a conductive path between the two ends of the tube. This safety is necessary when the tube is being installed into a fixture, while the lamp sockets are energized. In this situation, for example, when one end of the tube is inserted to the socket and energized and the other end is not, the pins on the free end shall not have hazardous live voltage.

With gas filled fluorescent tubes, this is not problem. However, when using retrofit Light Emitting Diode, LED, tubes, TLEDs, there is a conductive path between the two ends of the tube. When the pins are touched by a human the internal LED driver tends to conduct a current and starts operating, which usually exceeds a safety limit and cause a shock hazard.

The problem may be solved, for example, by galvanically isolating one side of the TLED from the mains. But in such a solution, the glow starter of the tube must be replaced by a short circuit in order to get the lamp working. Another known solution to such a problem is to employ a single ended input scheme for a TLED. However, such a tube is dependent on the direction in which the TLED is installed and the person installing the TLED should be aware of this. Furthermore, a single ended TLED is only popular in certain regions of the world. A single ended TLED may be converted to function as a double ended TLED, but additional circuitry or elements are needed to be added which increase the complexity and cost of the TLED. This is not desirable.

Another commercially available TLED is the double ended TLED, wherein the TLED can be installed in any physical orientation. Such a configuration exposes the installer to a risk of an electrical shock caused by the leakage current when a person installing the tube comes into contact with one of the pins during installation. A known solution is to install an additional electrical safety switch inside the TLED that prevents the flowing of a current before the TLED is properly installed. Such a solution also involves the additional elements and therefore increases the cost of the TLED.

Therefore, a solution that ensures safety and at the same time does not increase the cost of the device is desirable.

SUMMARY

It would be advantageous to achieve a Light Emitting Diode, LED, based lighting device that is arranged for detecting the presence of a human body in the power loop.

To better address one or more of these concerns, in a first aspect of the present disclosure, there is provided a Light Emitting Diode, LED, based lighting device arranged for connection to an Alternating Current, AC, mains supply, comprising:

a zero-crossing detection module arranged for detecting a zero-crossing in an AC voltage supplied by said AC mains supply;

a detection pulse module arranged for providing a detection pulse based on said detected zero-crossing;

a human body detection module arranged for determining a current drawn from said AC mains supply during said provided detection pulse, and for determining presence of a human body based on said determined current, wherein said detection pulse module is arranged for providing said detection pulse after said detected zero crossing.

The detection pulse module may thus be arranged for providing the detection pulse during a positive, rising, edge of a rectified AC voltage. Preferably, the detection pulse starts at the same time that the zero-crossing is detected.

The above described principle relates to LED based lighting device and, more specifically, to double-ended LED based lighting devices. Here, it may be required to perform human body model detection before the LED based lighting device is actually turned on. This ensured that the installation of the LED based lighting device can be performed safely.

Such functionality may be embodied in a pin-safety detection circuit which proves for the presence of a human body after the AC mains supply is applied. In case mains is detected, and no human body presence is detected, the driver in the LED based lighting device is enabled for turning the LED based lighting device on.

The presence of a human body in the power loop may be detected by measuring the mains impedance. Current is drawn from the main supply when the mains voltage reaches a certain threshold. Based on the peak value of the mains current, it can be concluded whether a human body is present. That is, if the peak is much lower than expected, a human body may be present in the power loop. Such a detection proves may be performed once or several times before enabling the driver.

One of the advantages of the present disclosure is that it enables that a large number of LED based lighting device may be connected to one circuit breaker and may still be able to successfully perform human body detection. This will be explained in more detail with reference to the figures.

One of the aspects of the present disclosure is that a current is measured during a detection pulse. The detection pulse is provided by the detection pulse module.

In any case, two scenario's may be compared. A first scenario relates to the concept when no human body is present. A second scenario relates to the concept that a human body is actually present in the power loop. It is clear the total impedance that is perceived in the power loop is higher for the second scenario, as the human body may be modelled by a relatively large impedance.

The above has the effect that the current drawn from the AC mains supply may differ in both scenario's. It is likely that the current drawn in the first scenario is higher than the current in the second scenario. The ratio between the currents in both scenario's may say something about the accuracy in which the presence of a human body can be detected.

It was one of the insights of the inventors that it may be beneficial when the detection pulse is after the zero-crossing of the AC mains supply voltage. The ratio between the above two described measured currents may be improved in case the detection pulse is after the zero-crossing.

In an example, the LED based lighting device further comprises:

a mains peak detection module arranged for detecting a peak voltage of said AC voltage, and wherein said detection module is further arranged for determining a duration of said detection pulse based on said detected peak voltage.

The inventors have found that, in order to improve the accuracy of the detection process, the detection pulse may be adjusted in accordance with the applied AC mains supply, for example 277 Vac or 120 Vac.

In an example, the human body detection module is arranged for determining presence of said human body based on:

a ratio between said determined current and a predetermined current.

The predetermined current may be the current that is drawn from the AC mains supply when no human body is present in the power loop. This may thus form some sort of calibration current. If the determined current is much lower than the calibration current, it may be concluded that a human body is present in the power loop. As such, the ratio between the determined current and the predetermined current may form an input to determine whether a human body is present.

In a further example, the LED based lighting device further comprises:

a current limiter arranged for ensuring a constant current drawn from said AC mains supply during said provided detection pulse.

During the duration of the detection pulse, the current that is drawn from the AC mains supply may vary. It is likely that the amount of current drawn from the AC mains supply increases during the duration of the detection pulse. This makes the process of detecting a human body more inaccurate. The current limiter may ensure that the current drawn during the detection pulse is kept constant, such that the accuracy is improved.

In yet another example, the detection pulse module is arranged for providing a calibration pulse, wherein an end of said calibration pulse and a start of said detection pulse both correspond to said detected zero-crossing, wherein said human body detection module is further arranged for determining a current drawn from said AC mains supply during said provided calibration pulse, and wherein said current limiter is further arranged for ensuring no current is drawn from said AC mains supply during said provided calibration pulse.

In a further example, said human body detection module is further arranged for measuring a voltage of said AC mains supply at a beginning of said calibration pulse, and for determining presence of a human body based on said measured voltage.

The above described examples may be summarized as follows. To cancel, or reduce, the influence of serial inductance of cabling present between the mains and the LED based lighting device, and even with large inductances of EM ballasts, there may be a need to ensure that the current during the measurement is constant. This is accomplished using the current limiter as described above.

It was further found that, in order to measure the resistance of the total chain accurately, i.e. the resistance of the cable and the resistance of a human body (if present), the descending slope of one half cycle the time the sine wave takes to go from a trigger voltage to zero volt without the current limiter on, so no current will flow during that particular time, may be measured. At the rising slope, i.e. just after zero volt detection, the current limiter may be switched on again.

Then, it is possible determine the difference of an unloaded mains and a loaded mains. The current by the current limiter is also known. The current is stable, and is equal to a particular set current, so that the voltage across the serial inductance equals zero. It is then possible to determine the resistance of the current loop.

In a further example, the calibration pulse has a same duration as said detection pulse.

In a second aspect of the present disclosure, there is provided a method of determining presence of a human body by a Light Emitting Diode, LED, based lighting device in accordance with any of the examples as provide above.

The method comprises the steps of:

detecting, by said zero-crossing detection module a zero-crossing an said AC voltage supplied by said AC mains supply;

providing, by said detection pulse module, said detection pulse based on said detected zero-crossing;

determining, by said human body detection module, said current drawn from said AC mains supply during said provided detection pulse, and determining presence of said human body based on said determined current;

Wherein said detection pulse module is arranged for providing said detection pulse after said detected zero-crossing.

It is noted that the advantages and definitions as disclosed with respect to the embodiments of the first aspect of the invention also correspond to the embodiments of the second aspect of the invention, being the method of determining presence of a human body in the power loop.

In an example, the LED based lighting device further comprises a mains peak detection module arranged for detecting a peak voltage of said AC voltage, and wherein said method comprises the further step of:

determining, by said detection module, a duration of said detection pulse based on said detected peak voltage.

In another example, the human body detection module is arranged for determining presence of said human body based on:

a ratio between said determined current and a predetermined current.

In a further example, the LED based lighting device further comprises:

a current limiter arranged for ensuring a constant current drawn from said AC mains supply during said provided detection pulse.

In yet another example, the detection pulse module is arranged for providing a calibration pulse, wherein an end of said calibration pulse and a start of said detection pulse both correspond to said detected zero-crossing, wherein said human body detection module is further arranged for determining a current drawn from said AC mains supply during said provided calibration pulse, and wherein said current limiter is further arranged for ensuring no current is drawn from said AC mains supply during said provided calibration pulse.

In a further example, the method further comprises the step of:

measuring, by said human body detection module, a voltage of said AC mains supply at a beginning of said calibration pulse, and determining presence of a human body based on said measured voltage.

In an example, the calibration pulse has a same duration as said detection pulse.

In a third aspect of the present disclosure, there is provided a computer program product comprising a computer readable medium having instructions stored thereon which, when executed by a Light Emitting Diode, LED based lighting device, cause said LED based lighting device to implement a method in accordance with any of the examples as provided above.

These and other aspects of the invention will be apparent from and elucidated with reference to the embodiment(s) described hereinafter.

DETAILED DESCRIPTION

Figure 1:
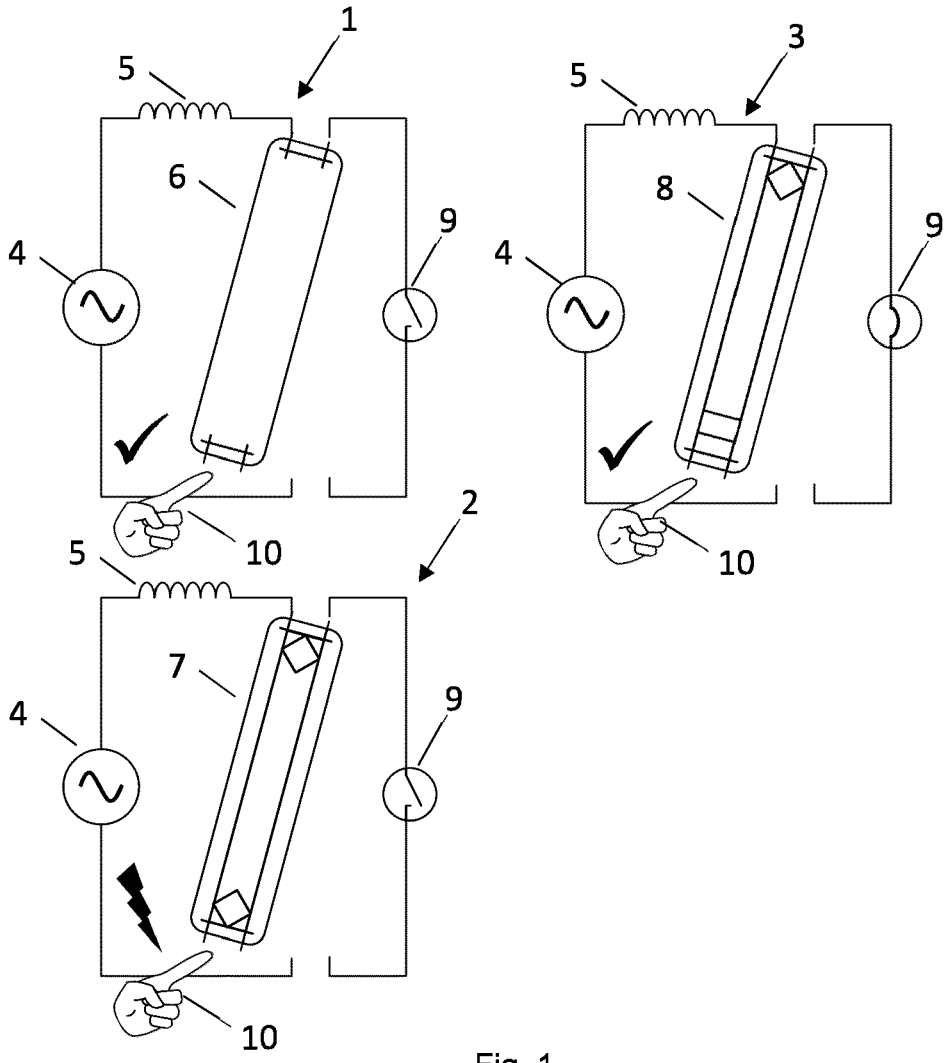
FIG. 1 shows an LED based lighting device in accordance with the prior art.

FIG. 1 shows an LED based lighting device 1 in accordance with the prior art.

FIG. 1 illustrates possible scenarios during installation of different kinds of tubes. Fluorescent TL tubes, as indicated by reference numeral 1, are inherently safe because the gas inside the tube 6 first has to be ignited before there is a conductive path between the two ends of the tube. The tube 6 is connected to an Alternating Current, AC, mains voltage power supply 4 such as the ones commonly found in domestic buildings. The tube 6 or the fixture into which the tube 6 is installed may comprise of additional elements such as a ballast 5 and a jumper or a starter element 9.

This safety is necessary when the tube 6 is being installed into a fixture while the lamp sockets are energized, i.e. the mains voltage is present. In the situation when one end of the tube is inserted to the socket and energized and the other end not, the pins of the free end shall not become live.

With gas filled fluorescent tubes, such as 6, this is not a problem, but when using LED lighting devices 7 there is a conductive path between the two ends of the tube as indicated in reference numeral 2. When the pins are touched by a human 10, i.e. a human body is present in the power loop, the internal LED driver tends to conduct a current, which usually exceeds a safety limit and causes a shock hazard.

A known solution to this problem is to apply the mains input only at one side of the tube, as indicated by reference numeral 3. The other side is thus galvanically isolated from the mains 4. In this case there is no conductive path between the two sides of the tube, but the glow starter must be replaced by a short 9 to get the lamp 8 working.

Figure 2:
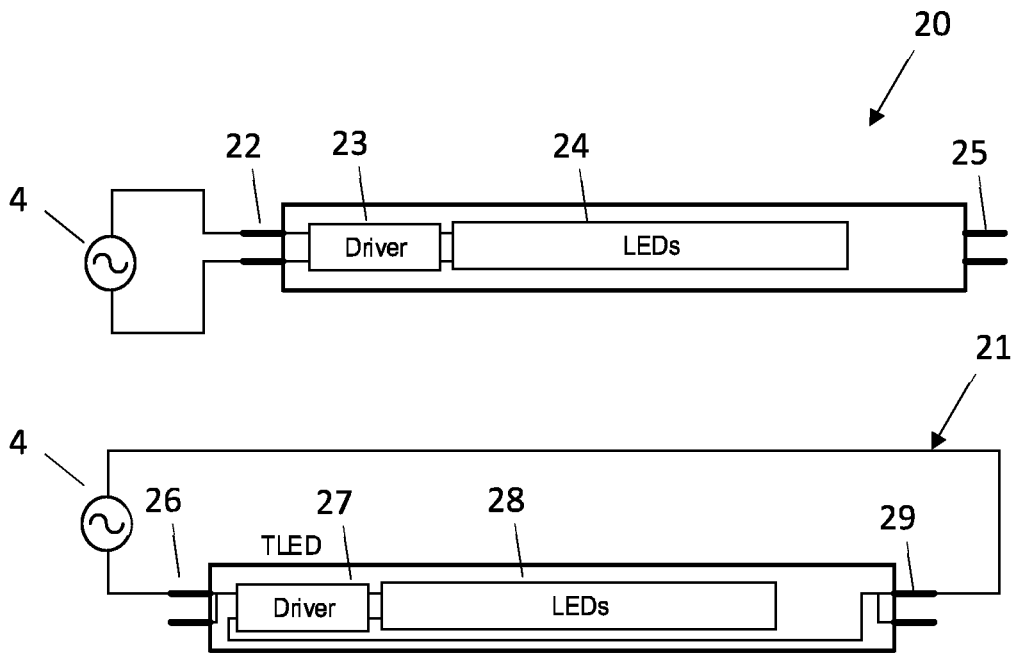
FIG. 2 shows another LED based lighting device in accordance with the prior art, wherein said LED based lighting device comprises a pin-safety circuit.

FIG. 2 schematically illustrates single ended 20 and double ended tubes 21 known according to the prior art. Since the TLED has four input terminals, there are two major input schemes in the market: single-ended 20 and double-ended 21. The double-ended input scheme is unsafe unless pin safety measures are taken inside the lamp. The single ended tube 20 comprises of a two sets of terminals 22, 25. The internal components such as the driver 23 and the Light Emitting Diode, LED, array, 24 are connected only to one set of terminals 22.

Therefore, a disadvantage of the single-ended input is that an installer needs to note which one of the two sets of terminals 22, 25 shall be connected to mains 4, and then install the lamp accordingly. If the lamp is wrongly installed, the lamp will not light up.

To address this issue, the single-ended input tubes may be made orientation independent by adding a jumper wire, not shown. In this way the lamp will just work either way of installing. However, adding a jumper wire adds cost.

It is evident from reference numeral 21 that a double ended tube can work irrespective of the orientation in which it is installed, since both sets of terminals 26, 29 are internally shorted and are connected to the internal components such as the driver 27 and LED array 28. However, during installation, if, for example, terminal 26 is inserted first, a person, i.e. a human body, coming into contact with terminals 29 is at a risk of getting an electrical shock since the other end 29 is not electrically isolated from the first end 26.

The present disclosure is directed to the introduction of a pin safety circuit which is arranged for detecting the presence of a human body in the power loop based on a measured impedance. Current may be drawn from the mains supply voltage 4 when the mains supply voltage reaches a certain threshold. Based on the peak value of the current, it can be concluded whether a human body is present, or not. In other words, it the peak current is much less than expected, it may be concluded that a human body is present in the power loop.

Figure 3:
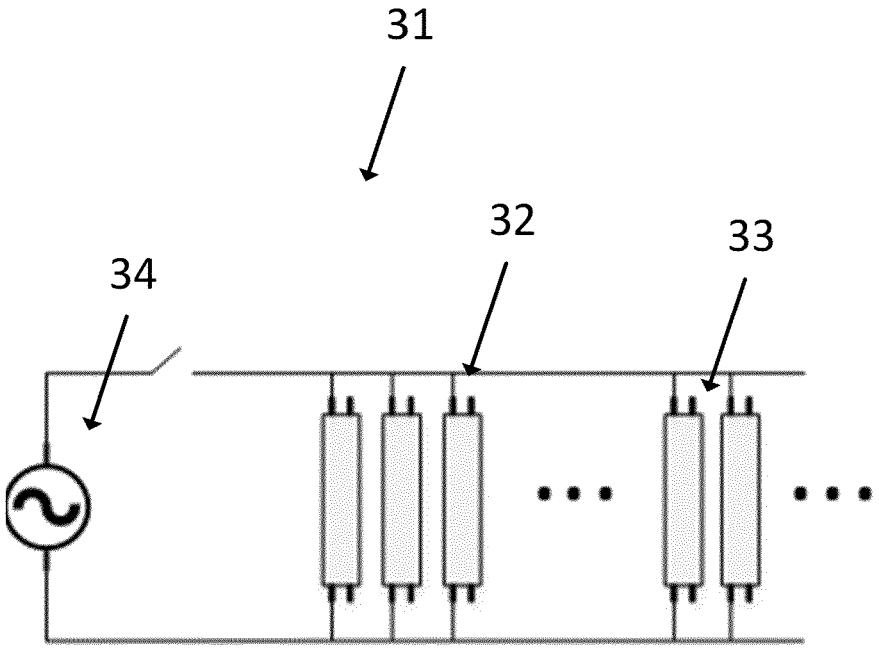
FIG. 3 shows a system of a mains power supply with a plurality of parallel cascaded LED based lighting devices.

One of the advantages of the present disclosure is related to a system 31 in which a single mains power supply 34 is arranged to supply power to a plurality of parallel cascaded LED based lighting devices 32, 33, as shown in FIG. 3.

By simultaneously turning a plurality of LED based lighting devices on, a reduction in the ramp-up of the received current may occur. The mains power supply may perceive a large inductor, i.e. an aggregated inductor (AC source inductance multiplied by the number of parallel lamps) which simulates the plurality of LED based lighting device. This may cause each of the LED based lighting devices to falsely detect a human body. In other words, each of the LED based lighting devices may detect such a reduced current, which reduced current may resemble a human body present in the power loop. However, in this particular scenario, the reduced current is caused by the parallel cascaded LED based lighting device and not by the presence of a human body in the power loop.

Figure 4:
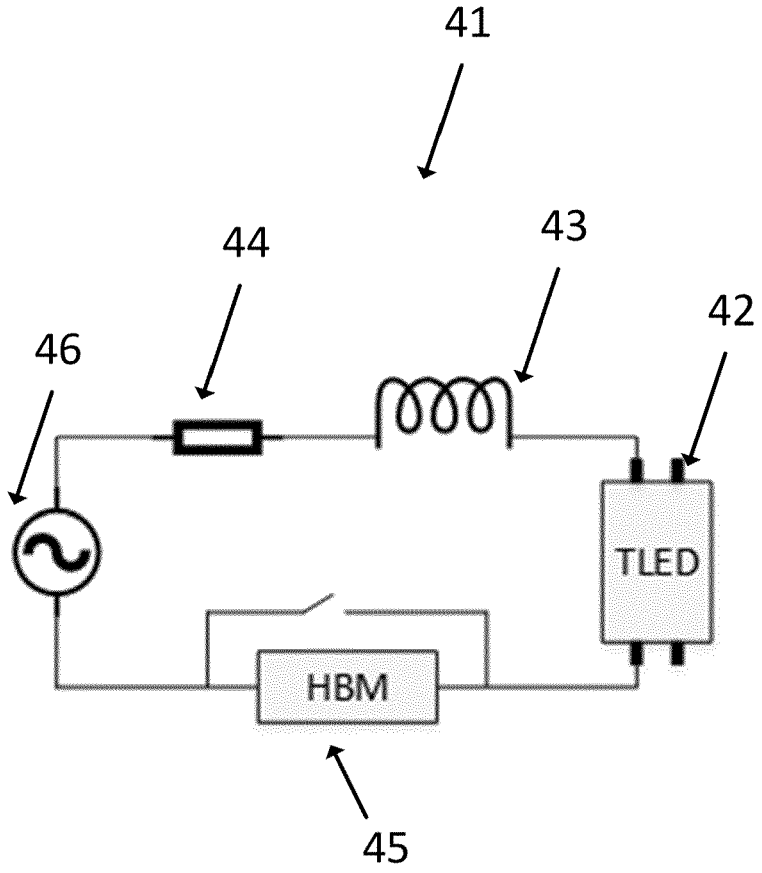
FIG. 4 shows a simulation circuit illustrating the concept of the present disclosure.

The above is also indicated in FIG. 4, which shows a simulation circuit 41 illustrating the concept of the present disclosure. FIG. 4 thus shows an equivalent circuit when utilizing a plurality of parallel cascaded LED based lighting devices.

Here, the mains supply voltage is indicated with reference numeral 46, the human body is indicated with reference numeral 45, and the LED based lighting device is indicated with reference numeral 42.

An impedance 44 and an inductor 43 are provided, which impedance 44 and inductor 43 simulate the presence of the AC source impedance and a plurality of LED based lighting device. In other words, the value for the impedance 44 may correspond to N times the output resistance of the mains power supply, wherein N relates to the number of LED based lighting devices. The value for the inductor 43 may correspond to N times the output inductance of the mains power supply, wherein N relates to the number of LED based lighting devices.

Following the above, it may be clear that the current received, i.e. the ramp-up, by the LED based lighting device 42 also depends on the number of LED based lighting devices in the system.

In accordance with the present disclosure, the LED based lighting device 42 comprises:

a zero-crossing detection module arranged for detecting a zero-crossing in an AC voltage supplied by said AC mains supply;

a detection pulse module arranged for providing a detection pulse based on said detected zero-crossing;

a human body detection module arranged for determining a current drawn from said AC mains supply during said provided detection pulse, and for determining presence of a human body based on said determined current, wherein said detection pulse module is arranged for providing said detection pulse after said detected zero-crossing.

The inventors have found that the detection of the presence of a human body in the power loop of the system should be performed after the detected zero-crossing, for example at a rising, positive, edge of the received AC mains power supply voltage. This increases the accuracy of the determination of the presence of a human body.

Figure 5:
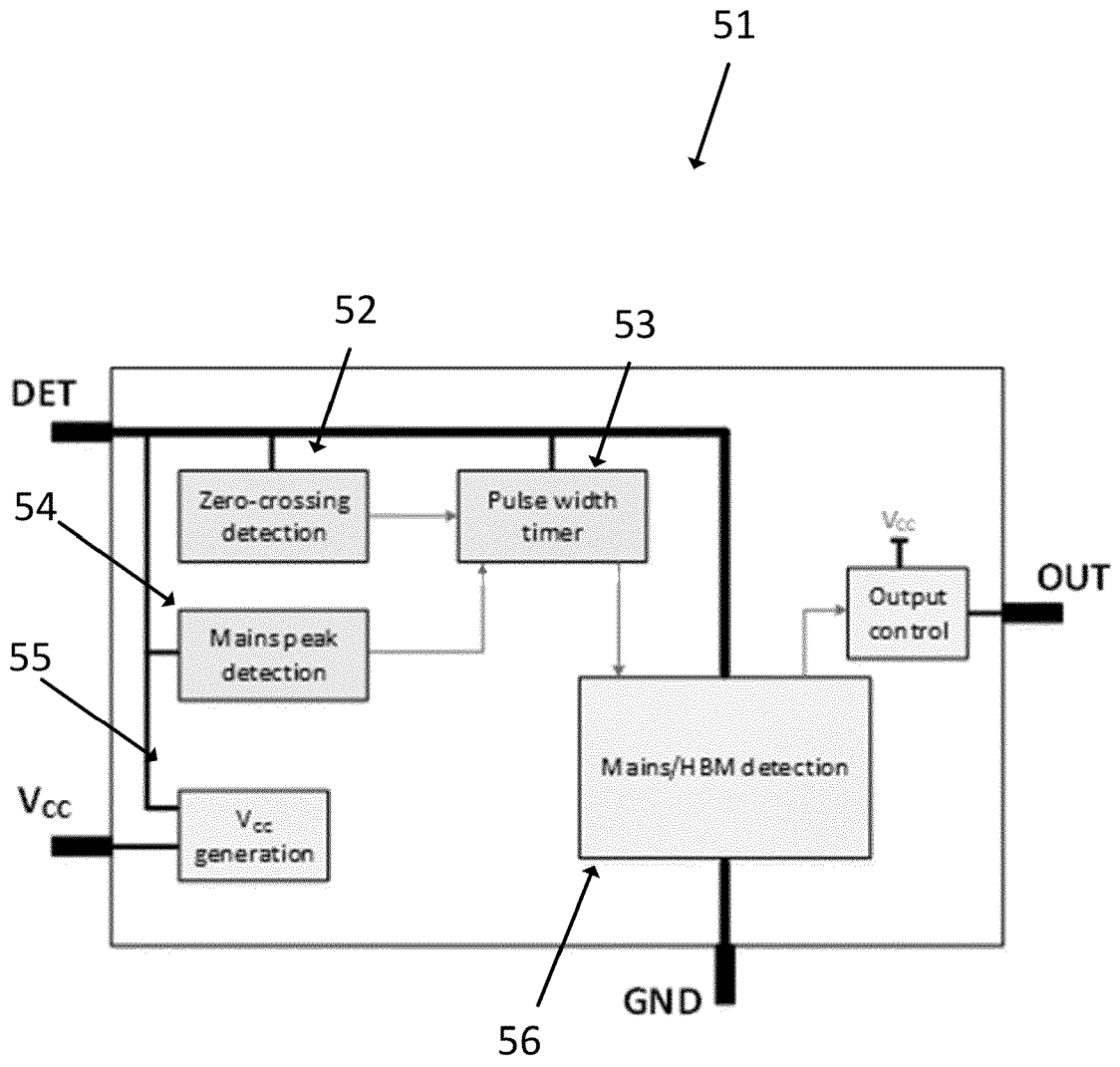
FIG. 5 shows building blocks of an integrated circuit, IC, arranged for performing a method in accordance with the present disclosure.

FIG. 5 shows building blocks of an integrated circuit, IC, 51 arranged for performing a method in accordance with the present disclosure;

The IC may have a zero-crossing detection module 52 which is arranged for detecting a zero-crossing in the AC voltage supplied by the AC mains supply.

The IC may further comprise a Voltage generation circuit 55 for generating the power required for the IC to operate normally.

Further, a mains peak detection and a pulse width timer may be provided as indicated with reference numerals 54 and 53.

It was found that the voltage level of the AC mains supply voltage, for example 277V or 120V, may have an impact on the width of the detection pulse. So, the mains peak detection circuit 54 may determine the voltage of the received AC mains supply voltage and may, subsequently, command the pulse width timer 53 to set a particular pulse width for the detection pulse.

The pulse width timer may, subsequently, provide the detection pulse based on the detected zero-crossing to the human body detection module 56.

Figure 6:
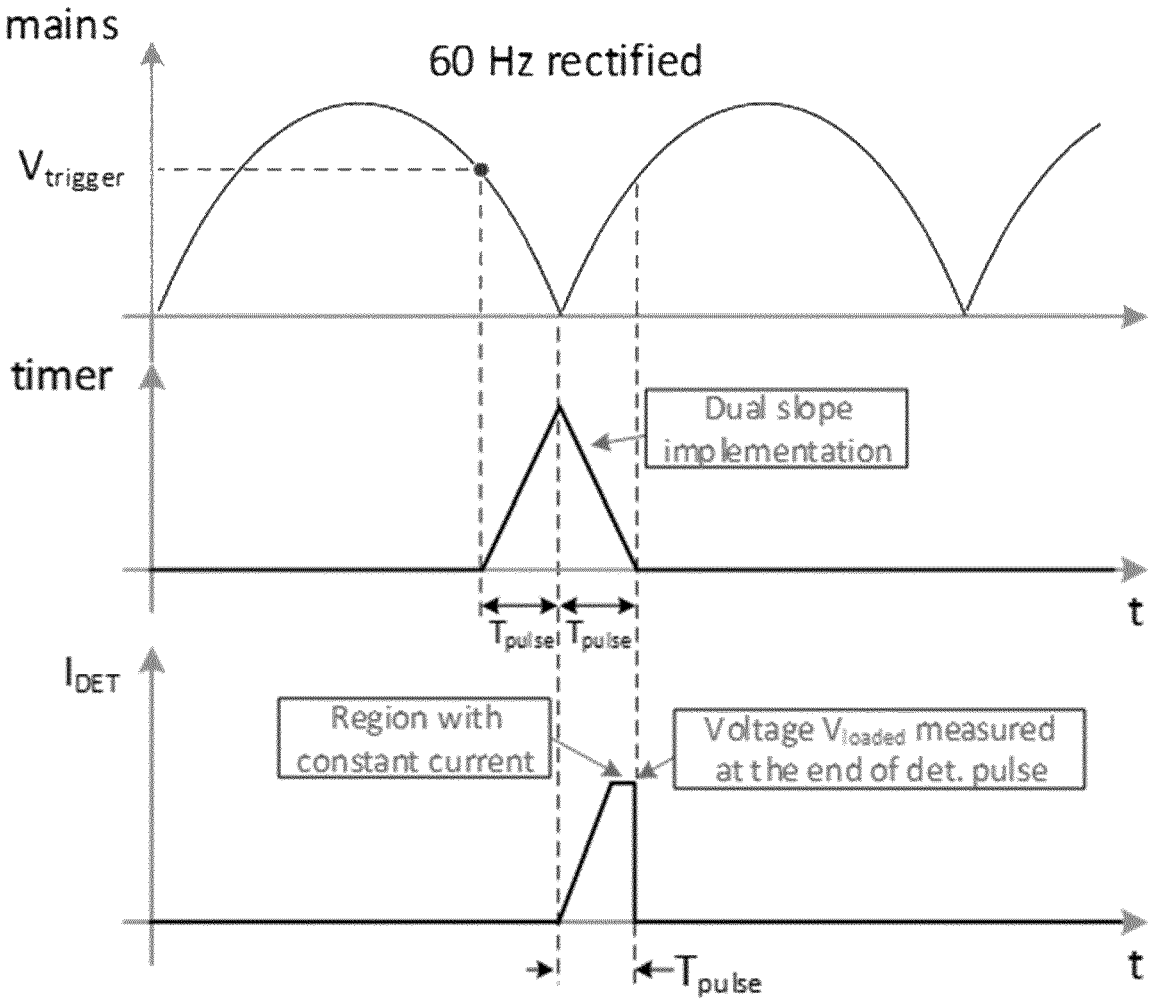
FIG. 6 shows a graph in which a calibration pulse and a detection pulse is utilized.

FIG. 6 shows a graph in which a calibration pulse and a detection pulse is utilized.

FIG. 6 discloses a further improvement of the above described detection method. The resistance of the HBM can be measured more accurate so that even with high large serial inductances, like present in EM ballasts, accurate results may be obtained.

It furthers improves that longer cables and a very large number of LED based lighting device to be placed in parallel and it may still successfully perform human body presence detection.

Type B TLED lamps, for example, with mains connection at two ends, may need to perform mains detection before switching ON in order to guarantee safe installation.

Detection methods may make use of a narrow detection pulse. Mains inductance, for example cabling, transformers, may have a dominant effect on rate of rise of detection current and its effect increases with the number of lamps connected in parallel. Therefore, the maximum number of lamps which can be connected in parallel may be limited.

FIG. 6 relates to two further enhancements of the presented method.

1. Impact of mains cabling inductance and inductance of EM ballast is cancelled or reduced by making sure that detection current is constant when voltage measurement takes place. For that reason, a current limit circuit, i.e. a current limiter, may be introduced.

2. Line resistance may be measured by measuring the difference in the voltage across current limiter without and with detection current being drawn, i.e. the line resistance equals (Vunloaded−Vloaded)/I. Without detection current, voltage across current limiter Vunloaded is equal to mains.

This level is predefined and equals to Vtriggertrack. To ensure that voltage Vloaded is measured at correct moment within mains half-cycle, when detection current is drawn, a dual-slope principle may be implemented. Namely, the timer is used to measure time interval at the falling slope of mains from the moment the mains crosses level Vtrigger until zero-crossing, i.e. the first slope. Then, this same timer may be used to set the length of detection pulse, being generated after the mentioned zero-crossing of mains, i.e. the second slope. In this way, the detection pulse ends at the moment when rising slope of unloaded mains crosses Vtrigger. Voltage Vloaded is measured at the end of detection pulse. As explained under point 1, impact of line inductance is cancelled by making sure that detection current is constant at the end of detection pulse.

It is noted that, once the current variation is zero, i.e. a constant current, there is no voltage drop on the serial inductance, so the voltage drop is then only resistive, which equals the human body resistance plus the serial resistance of the wiring. The voltage drop can be measured with the constant current.

Preferably, the time of the measurement from Vtrigger to zero volt, i.e. the calibration pulse, may equal the detection pulse. This may be accomplished in a variety of manners.

With an analogue circuit, use could be made of a dual slope principle, where the same time is generated as for the measured time from Vtrigger to 0V as well for the rising voltage, during that timeslot the voltage can be measured and the voltage drop can be determined with a constant current limiter.

With a digital counter which is generating the same time in the rising slope for probing the voltage as the measured time from Vtrigger to 0V.

Figure 7:
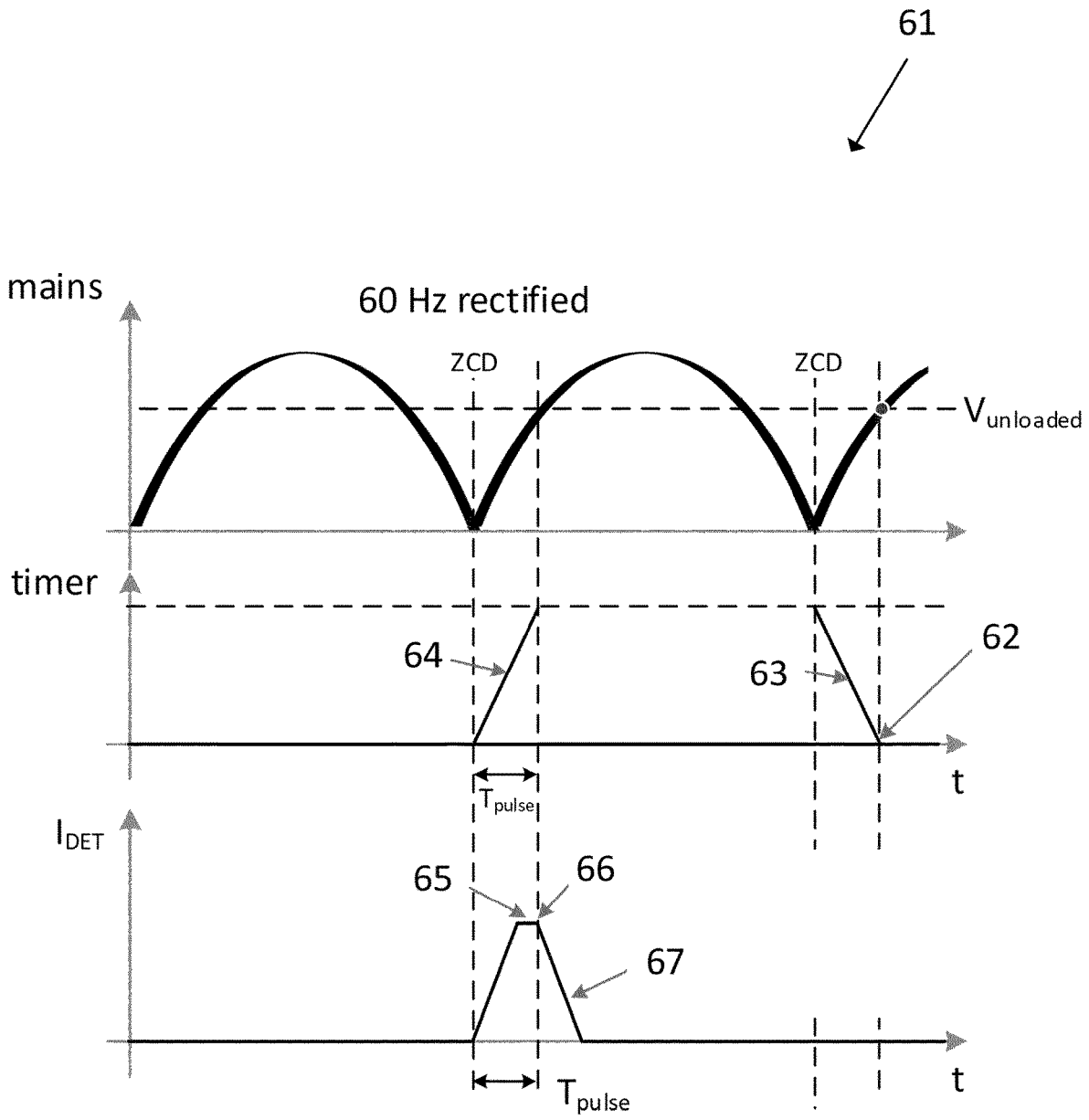
FIG. 7 shows another graph in which a calibration pulse and a detection pulse is utilized.

FIG. 7 shows another graph 61 in which a calibration pulse and a detection pulse is utilized.

Here, the reference numerals 62, 63 and 64 are related to the timer of the detection pulse. Reference numeral 64 is a timer that increases up till the end of the plateau. Reference numeral 63 decreases the timer from the plateau to zero 62.

The corresponding current is indicated with reference numerals 65, 66 and 67. Here, it is shown that the current increases up to the region with constant current as indicated with reference numeral 65. The voltage is then measured at the end of the detection pulse as indicated with reference numeral 66. The current is then ramped down with a slow slope to avoid high di/dt as indicated with reference numeral 67.

In any of the aforementioned pin safety circuits or detection methods, a stable mains voltage is assumed. In case the mains voltage is not stable e.g. the voltage fluctuations between each mains period exceeds a threshold, the measurement can result in a misinterpretation of the measured result. As a precaution, the detection of the detection pulse can be postponed until a detection of a stable mains is established. This can be done for example by sampling several mains cycles, e.g. three or more cycles, and compare the voltage difference between these cycles. When the difference is within an acceptable threshold, the pin safety circuit or the detection method can be activated or executed.

Additionally or alternatively to any of the aforementioned pin safety circuits or detection methods, a compensation for the non-linear behavior of diodes present in the LED based lighting devices, e.g. the diodes in a rectifier circuit, can be introduced. Instead of drawing no current from said AC mains supply during the calibration pulse, a small current can be drawn. This current is smaller than the current drawn during the detection pulse. Even when a small current is drawn, the voltage drop over a diode remains relatively stable because of the non-linear voltage-current characteristic behavior of a diode. if more current is drawn through the diode, the voltage will stall change but not as significantly as at the moment where a very small to no current is drawn. Therefore, the non-linear effect of the diode affecting the measurement will be drastically reduced.

Other variations to the disclosed embodiments can be understood and effected by those skilled in the art in practicing the claimed invention, from a study of the drawings, the disclosure, and the appended claims, In the claims, the word "Comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope thereof.

The invention claimed is:

1. A Light Emitting Diode (LED) based lighting device arranged for connection to an Alternating Current (AC) mains supply, comprising:

a zero-crossing detection module arranged for detecting a zero-crossing in an AC voltage supplied by said AC mains supply;

a detection pulse module arranged for providing a detection pulse based on said detected zero-crossing;

a human body detection module arranged for determining a current drawn from said AC mains supply during said provided detection pulse, and for determining presence of a human body based on said determined current; and a current limiter arranged for ensuring a constant current drawn from said AC mains supply during said provided detection pulse, wherein said detection pulse module is arranged for providing said detection pulse after said detected zero-crossing, wherein said detection pulse module is arranged for providing a calibration pulse, wherein an end of said calibration pulse and a start of said detection pulse both correspond to said detected zero-crossing, wherein said human body detection module is further arranged for determining a current drawn from said AC mains supply during said provided calibration pulse, and wherein said current limiter is further arranged for ensuring no current or a current lower than the current being drawn during the detection pulse is drawn from said AC mains supply during said provided calibration pulse.

2. The LED based lighting device in accordance with claim 1, wherein said LED based lighting device further comprises:

a mains peak detection module arranged for detecting a peak voltage of said AC voltage, and wherein said mains peak detection module is further arranged for determining a duration of said detection pulse based on said detected peak voltage.

3. The LED based lighting device in accordance with claim 1, wherein said human body detection module is arranged for determining presence of said human body based on:

a ratio between a determined current and a predetermined current.

4. The LED based lighting device in accordance with claim 1, wherein no current is drawn from said AC mains supply during said provided calibration pulse, wherein said human body detection module is further arranged for measuring a voltage of said AC mains supply at a beginning of said calibration pulse, and for determining presence of a human body based on said measured voltage.

5. The LED based lighting device in accordance with claim 1, wherein said calibration pulse has a same duration as said detection pulse.

6. The LED based lighting device in accordance with claim 1, wherein the detection of the detection pulse is postponed until a detection of a stable AC mains supply is established.

7. A method of determining presence of a human body by a Light Emitting Diode (LED) based lighting device, the method comprising:

detecting, by a zero-crossing detection module, a zero-crossing and an alternating current (AC) voltage supplied by an AC mains supply;

providing, by said detection pulse module, said detection pulse based on said detected zero-crossing;

determining, by a human body detection module, a current drawn from said AC mains supply during said provided detection pulse, and determining presence of a human body based on said determined current;

wherein said detection pulse module is arranged for providing said detection pulse after said detected zero-crossing.

8. The method in accordance with claim 7, wherein said LED based lighting device further comprises a mains peak detection module arranged for detecting a peak voltage of said AC voltage, and wherein said method comprises the further step of:

determining, by said mains peak detection module, a duration of said detection pulse based on said detected peak voltage.

9. The method in accordance with claim 7, wherein said human body detection module is arranged for determining presence of said human body based on:

a ratio between a determined current and a predetermined current.

10. The method in accordance with claim 7, wherein said method further comprises the step of:

measuring, by said human body detection module, a voltage of said AC mains supply at a beginning of said calibration pulse, and determining presence of a human body based on said measured voltage.

11. The method in accordance with claim 10, wherein said calibration pulse has a same duration as said detection pulse.

* * * * *